US006210753B1

(12) United States Patent
Vohs

(10) Patent No.: US 6,210,753 B1
(45) Date of Patent: Apr. 3, 2001

(54) PROCESS FOR PRODUCING STRUCTURED COATINGS MADE OF POLYURETHANE FOAM

(76) Inventor: Fatima Vohs, Am Weisenstein 1, D-53639 Königswinter (DE)

( * ) Notice: Subject to any disclaimer, the term of this patent is extended or adjusted under 35 U.S.C. 154(b) by 0 days.

(21) Appl. No.: 09/242,368

(22) PCT Filed: Aug. 12, 1997

(86) PCT No.: PCT/EP97/04365

§ 371 Date: Feb. 12, 1999

§ 102(e) Date: Feb. 12, 1999

(87) PCT Pub. No.: WO98/06769

PCT Pub. Date: Feb. 19, 1998

(30) Foreign Application Priority Data

Aug. 13, 1996 (DE) ..... 196 32 513
Aug. 15, 1996 (DE) ..... 196 32 987

(51) Int. Cl.[7] ..... B05D 3/12

(52) U.S. Cl. ..... 427/244; 427/273; 427/274; 427/280; 427/341; 427/358; 427/407.1

(58) Field of Search ..... 427/243, 244, 427/337, 340, 341, 355, 356, 358, 271, 273, 274, 280, 407.1

(56) References Cited

U.S. PATENT DOCUMENTS

| | | | | |
|---|---|---|---|---|
| 4,193,957 | | 3/1980 | Kauffman et al. | 264/46.4 |
| 4,350,775 | | 9/1982 | Blount | 521/100 |
| 4,515,646 | * | 5/1985 | Walker et al. | 156/78 |
| 4,596,725 | * | 6/1986 | Kluth et al. | 427/385.5 |
| 5,416,125 | | 5/1995 | Liman et al. | 521/160 |

FOREIGN PATENT DOCUMENTS

| | | |
|---|---|---|
| 638 729 | 10/1983 | (CH) . |
| 21 12 397 | 9/1972 | (DE) . |
| 23 47 988 | 4/1975 | (DE) . |
| 16 69 771 | 9/1976 | (DE) . |
| 41 20 306 A1 | 12/1992 | (DE) . |
| 43 37 012 A1 | 5/1995 | (DE) . |
| 44 41 570 A1 | 5/1996 | (DE) . |
| 44 41 696 A1 | 5/1996 | (DE) . |
| 0 160 716 | 11/1985 | (EP) . |
| 0 066 830 | 1/1991 | (EP) . |
| 54 083524 | 12/1952 | (JP) . |

* cited by examiner

*Primary Examiner*—Erma Cameron
(74) *Attorney, Agent, or Firm*—Pauley Petersen Kinne & Fejer

(57) ABSTRACT

A process for producing decorative, three-dimensionally structured coatings from polyurethane foam on a substrate. A foamable mixture based on a one-component or two-component system is applied to the substrate to be coated, optionally under pressure. The foamable mixture applied is spread, distributed and structured immediately thereafter and during foaming and incipient crosslinking of the mixture on the substrate under the influence of mechanical force, forms a layer.

26 Claims, No Drawings

PROCESS FOR PRODUCING STRUCTURED COATINGS MADE OF POLYURETHANE FOAM

This is a national stage application under the PCT (filed under 35 U.S.C. 371).

BACKGROUND OF THE INVENTION

1. Field of the Invention

This invention relates to a process for producing decorative three-dimensionally structured coatings from polyurethane foam on a substrate.

2. Description of Prior Art

Polyurethane foams are based on three components:

A: polyisocyanates;

B: polyols; and

C: auxiliaries, optionally including blowing agents.

The polyurethane is obtained by polyaddition of dihydric and/or polyhydric alcohols (B) and isocyanates and/or prepolymers with terminal isocyanate groups (A). Auxiliaries (C) are known catalysts, stabilizers, pigments, blowing agents, surfactants, emulsifiers, foam stabilizers, flame retardants, fillers, antioxidants, antistatic agents and biocides.

Polyurethane foam is produced either by a chemical blowing process, based on the reaction between isocyanate and water which yields $CO_2$ as blowing gas, or by the physical blowing process with low boiling point blowing agent components, such as halogenated hydrocarbons and/or readily volatile nonhalogenated hydrocarbons, such as pentane, cyclopentane, propane, isobutane, and dimethylether.

The raw materials are commercially available as a one-component or two-component mixture for processing into polyurethane foam.

Diphenylmethane-4,4'-diisocyanate (MDI) or 2,4- or 2,6-toluene diisocyanate is preferably used as isocyanate for producing polyurethane foam.

Polyurethane foams which are more flexible are obtained by chemical foaming with polyalkylene glycol ethers as diols and isocyanates as well as water.

Polyurethane foams which are more rigid are obtained with mixtures based on polyols and isocyanates which are foamed using physical blowing agents.

Normally polyurethane foam is processed into finished products by foam molding in closed molds or is used as bonding foam for filling cavities and fastening components in the construction industry, because polyurethane foam is tacky in the nascent state at the beginning of crosslinking and adheres well to many materials, such as wood, metal, concrete, masonry.

German Patent Reference DE-OS 21 12 397 describes a plastics material based on polyurethane foam which can be used as a decorative domestic rendering for internal and external walls in the form of foam wall panels.

Japanese Patent Reference JP 54083524 A discloses foamable paints containing a foamable resin, such as foamable polystyrene, foamable polyethylene or foamable polyurethane and a colorant and a binder, in particular a plastics material such as PVC, polyacrylonitrile or polymethacrylate to which organic or inorganic blowing agents, such as azodicarbonamide or sodium bicarbonate, are added, for painting pictures which, after drying at room temperature, are heated to a temperature of 90 to 200° C. depending on the plastics material, for foaming purposes.

Foamable paints of this type are not suitable for producing domestic renderings used over large areas, as they cannot be heat treated to 200° C. in order to obtain a foam.

European Patent Reference EP-A-0160 716 discloses a process for the production of thin flat insulating layers, whereby a low-boiling solvent comprising a one-component-PUR-mixture is applied to a surface like a lacquer by rolling, spreading, spraying or dipping thereafter, these layers being foamed up to a uniform insulation layer.

SUMMARY OF THE INVENTION

This invention achieves one object with a process for producing three-dimensionally structured, in particular flat coatings or layers of polyurethane foam on a substrate.

Such object of this invention is to find further advantageous fields of application for polyurethane foam, in particular for foamable polyurethane mixtures packaged as one-component or two-component systems, optionally with physical blowing agents, in pressurized containers such as aerosol cans for producing polyurethane foam in rigid or semi-rigid formulations.

The property of known commercially available foamable polyurethane mixtures to foam and crosslink very rapidly and uncontrollably inhibits many types of shaping and application so these foamable polyurethane mixtures have formerly been introduced only into existing, substantially closed molds or cavities for foaming purposes or, during free-rise foaming, subsequent mechanical treatment and shaping by cutting or the like has been carried out only after curing of the foam.

This invention relates to a process for producing coatings from polyurethane foam (PUR foam) on a substrate, in which a foamable mixture for producing polyurethane foam based on a one-component or two-component system, containing isocyanate and/or prepolymers with terminal isocyanate groups and dihydric and/or polyhydric alcohols as well as auxiliaries is applied to the substrate to be coated as a layer.

This invention achieves the object with improvement of the process because the mechanical structuring and influencing of the surface of the foamable mixture being flat applied onto the substrate for producing a decorative three dimensionally structured coating immediately thereafter and during foaming and incipient crosslinking of the mixture on the substrate superficially under the influence of force by mechanical regularly or irregularly distribution of the mixture is processed and consequently a regionally varied volume of the developing foam of the structured layer such formed is obtained.

In particular, foamable mixtures which cure with moisture from the environment while crosslinking are used.

This invention can be accomplished using polyurethane foams produced from a one-component system or two-component system based on isocyanates, polyols and auxiliaries by the chemical blowing process and/or physical blowing process with a physical blowing agent.

Coatings are preferably produced from rigid and semi-rigid polyurethane foams for this invention.

With the two-component system, a base component comprises the polyols, catalysts, stabilizers, optionally blowing agents, pigments and other auxiliaries while the second component, as crosslinking component, contains the isocyanate. It is possible to react the isocyanate with a proportion of the total quantity of polyol required to form a prepolymer leaving only the remainder of polyol in the base component for producing the polyurethane foam.

According to this invention, it is possible to produce flat and structured polyurethane foam coatings by free foaming a foamable mixture applied to a substrate chemically or using physical blowing agents or as a combination of the two processes, optionally with additional wefting or spraying the surface of the applied mixture with water, which forms an excellent external rendering or internal rendering on walls of buildings.

Advantageous developments of the process according to this invention can be inferred from the features of the claims.

DESCRIPTION OF PREFERRED EMBODIMENTS

One-component systems for producing polyurethane foam which are suitable for the invention are described, for example, in European Patent Reference EP 0 066 830 B2, German Patent Reference DE 44 41 696 A1 and German Patent Reference DE 44 41 570 A1 and in the literature cited in these documents along with suitable two-component systems. One-component and two-component systems for producing polyurethane rigid foams using physical blowing agents are commercially available, packaged, for example, in pressurized containers such as aerosol cans, steel bottles or the like. These polyurethane rigid foams which are described as bonding foam or in-situ foam are used in the building industry, in particular for filling cavities and joints, for insulating water pipes, sealing openings and gaps, as an adhesive for bridging unevenness on substrates for the application of further materials. The one-component or two-component mixture located in the pressurized containers is injected or sprayed into the cavities directly on site and fills the corresponding spaces or joints by foaming. According to this invention, these known foamable systems are used for producing flat structured coatings. To improve processability, it may be advantageous to delay the curing process. For producing external or internal rendering, it may be advantageous not to set the degree of foaming too high. A combination of chemical and physical blowing processes for the foamable mixture is considered advantageous for producing external or internal rendering. Polyol mixtures such as polyether and polyester polyols can be used as polyols for this purpose. Esters of aliphatic dicarboxylic acids containing 4 to 8 carbon atoms in the alkylene radical, which are reacted with diols, can preferably be used as polyester diols and ethylene glycol, diethylene glycol, 1,2- or 1,3-propylene glycol, dipropylene glycol, 1,4-butane diol and 1,6-hexane diol can be used as dihydric alcohols.

A foamable mixture which only foams and crosslinks chemically while utilizing the reaction between isocyanate and water after flat application to the substrate in the presence of atmospheric moisture can be used according to this invention.

The surface of the mixture distributed over the substrate can be wetted with water in selected regions or overall to assist chemical foaming of the foamable mixture.

The foamable mixture preferably contains a physical blowing agent and is applied under pressure from a pressurized container to the substrate to be coated.

The foamable mixture applied to the substrate is distributed flatly by a blade or knife or roller to form a layer of varying thickness of regular or irregular shape and the desired three-dimensional structure is consequently obtained by foaming, which varies regionally in volume, of the structured layer thus formed.

In one embodiment of this invention, prior to curing of a first layer of a foamable mixture applied to a substrate for producing a polyurethane foam, a further layer of a foamable mixture can be applied and distributed for producing a polyurethane foam.

Prior to application of a further layer of foamable mixture for producing polyurethane foam, the surface of the existing polyurethane foam layer on which the further layer is to be applied can be wetted with water.

It is also possible mechanically to distribute, spread and rub foamable polyurethane mixture enriched with a physical blowing agent with a foaming factor of 1:3 to 1:5 after injection under the pressure of the blowing agent (up to 20 bar) onto a substrate, even after the beginning of and during incipient foaming and even after incipient crosslinking. An interruption in the foaming process subdues the mixture which can be structured better mechanically. This mechanical treatment of the foamable mixture with or without physical blowing agent can be effected by knife application, stirring, plucking, spreading, combing and the like. Foaming is delayed by the mechanical treatment and bubbles are not formed until after distribution of the mixture, resulting in alternate bubble-rich and bubble-deprived regions according to the regular or irregular distribution of the foamable mixture, i.e. denser regions and highly foamed regions. As a result, the spatial structure and density of the foamed coating can be varied enormously. The polyurethane foam coating produced usually has a density in the range of about 10 to 80 kg/m$^3$.

Thus, for example, relief-like, mountain-like three-dimensional structures, structures resembling strings of pearls or flat flake-like or screen-like surface structures can be achieved.

In particular, coatings according to this invention can also be produced as external rendering or internal rendering for walls of buildings. The polyurethane foam layers produced have a structured but crosslinked surface layer which is waterproof and abrasion resistant, but the overall coating is sufficiently breathable.

The structured polyurethane foam layer applied according to this invention can also have a paint coating in order, for example, to increase the UV resistance or to achieve a decorative effect. It is also possible to add a colorant to the foamable mixture in order to obtain a self-colored foam layer.

An advantageous development of this invention involves the combination of mechanical surface treatment of the foamable mixture applied flat, for example sprayed, onto a substrate as a coating in conjunction with a paint coating, i.e. the application of a colorant. In this case, the colorant can be applied and distributed in the form of a lacquer or a dispersion, for example using a roller or blade, the surface of the foamable mixture applied being mechanically structured and influenced during foaming and crosslinking simultaneously with the application and distribution of the colorant.

According to this invention, it has been found that the foamable polyurethane mixture applied to a substrate can be distributed mechanically by the application of force even after the beginning of foaming and incipient crosslinking, after a tacky surface skin has been formed. In particular, it is possible to pluck or tear away the coating at the surface to produce additional structuring. This treatment according to this invention can be used particularly advantageously for extremely decorative coatings of the type desired in artistic work for three-dimensional pictures, paintings and reliefs.

It is also possible to apply to a first layer of foamable polyurethane mixture one or more further foamable polyurethane mixtures in layers or only regionally to create elevations. This can be effected in the not yet fully foamed and/or cured state of the existing layer. To increase adhesion, the degree of crosslinking or the degree of foaming, if necessary, it may be beneficial to wet the existing layer superficially with water. Additional $CO_2$ which acts as a blowing agent can thus be formed during the reaction with the isocyanate.

It is also possible with the process according to this invention to produce flat three-dimensionally structured configurations of a decorative type as paintings or collages, reliefs individually or integrated in the rendering in wall surfaces or the like. It has been found according to this invention, in particular, that the foamable polyurethane mixture also adheres very readily to canvas, cotton fabric, jute and other natural fibers.

In particular, the process according to this invention allows any three-dimensional structures of a flat foam configuration to be produced by varying the thickness of the foamable polyurethane mixture applied, followed by appropriate regular or irregular mechanical distribution. The layer formed in this way can still be treated mechanically, for example with cutting blades, or can be provided with a paint or pigmented coating or a glaze even after completion of foaming and crosslinking. Any conventional commercial paints in the form of dispersions, emulsions, plastic dispersions, or dissolved in solvents, which adhere well to polyurethane foam, can be used as colorant, pigmented coating or glaze. The foamable mixture can be applied using disposable pressurized containers, spray guns or other suitable devices.

According to a further embodiment of this invention, a nozzle can be provided for application of the foamable mixture, the nozzle being designed either as a simple round nozzle or as a nozzle with several separate round nozzles as outlet or as a slit nozzle, broad slit nozzle and optionally with milled shaping for structural lines.

Furthermore, it is also possible to finish the surface of the applied layer of polyurethane foam by scattering, for example, sand over it, this scattering being carried out at the moment when the surface of the polyurethane foam is still tacky and not completely crosslinked.

The mechanical treatment of the foamable polyurethane mixture applied, to a substrate preferably takes place within 10 minutes of application. With very thick foamable layers, this time interval for mechanical treatment in the not yet cured state of the polyurethane foam is extended.

Conventional commercial foamable mixtures for producing polyurethane foam with a preferably CFC-free physical blowing agent, based on diphenylmethane-4,4'-diisocyanate, which cure in moisture at +5° C. to +30° C., for example, have proved suitable for the use according to this invention.

Providing the foamable mixture has not yet cured, it can be shaped to a greater or lesser extent. Curing and crosslinking have generally progressed so far after 2 hours that significant shaping is no longer possible.

It is also possible to give the foamable mixture a low-flammability finish using flame retardants, for example building material category B1 or B2 according to DIN 4102. Examples include inorganic fillers such as aluminium hydroxides, ammonium polyphosphates and organic chlorine-, bromine- and/or phosphorus- or nitrogen-containing compounds which are optionally chemically bound to the polyurethane.

Flame retardants can be added to the foamable mixture in normal quantities, in particular about 2 to 18% by weight, based on the foamable mixture. Foamable polyurethane mixtures having a flame retardant or low-flammability finish allow the production of rendering on walls of buildings by the process according to this invention both internally and externally in compliance with building regulations.

In external applications, the foamable mixture can additionally contain biocides for protection against attack by micro-organisms.

In particular, antioxidants against photo-oxidation and hydrolysis can also be added to the foamable mixture in the normal quantities.

Furthermore, it is also possible simply to touch up the layers according to this invention, for example when used as rendering, at a later stage if cracks etc. appear, as it is merely necessary to apply foamable polyurethane mixture to the area to be repaired.

With the process according to this invention, therefore, it is possible to produce surface coatings based on polyurethane foam in the form of external rendering or internal rendering for walls of buildings in structured form from foamable, one-component or two-component polyurethane systems optionally containing blowing agent and also to provide them with paint finishes.

The following advantages over normal mineral rendering can be achieved with this invention:

much lower specific gravity;
lower transport volume, weight and costs;
simpler handling, even for do-it-yourselfers;
problem-free repair of cracks and the like;
soft surface with a pleasant feel;
reduced risk of injury owing to the softer elastic surface of the rendering;
smaller layer thickness with improved insulating effect;
UV stability owing to UV-resistant coating or paint coating; and
temperature resistant from minus 40° C. to plus 130° C.

What is claimed is:

1. In a process for producing coatings from polyurethane foam on a substrate, in which a foamable mixture for producing the polyurethane foam based on a one-component or two-component system and at least resulting from a physical blowing with a physical binwing agent, containing isocyanate and/or prepolymers with terminal isocyanate groups and dihydric and/or polyhydric alcohols and auxiliaries is applied to the substrate to be coated as a layer the improvement comprising: a mechanical structuring and influencing of the surface of the foamable mixture being flat applied onto the substrate for producing a decorative three dimensionally structured coating immediately thereafter and during foaming and incipient crosslinking of the mixture on the substrate superficially under an influence of force by one of mechanical regularly and irregularly distribution of the mixture is processed and consequently a regionally varied volume of the developing foam of a structured layer formed is obtained, resulting in bubble-rich and bubble-deprived regions according to the distribution of the mixture.

2. In the process according to claim 1, wherein the foamable mixture cures with moisture from an environment while crosslinking.

3. In the process according to claim 2, wherein the foamable mixture is used which foams and crosslinks only chemically while utilizing a reaction between isocyanate and water, after flat application to the substrate in the presence of atmospheric moisture.

4. In the process according to claim 3, wherein the surface of the mixture distributed over the substrate is wetted with water in selected regions or overall to promote chemical foaming of the foamable mixture.

5. In the process according to claim 4, wherein the foamable mixture contains a physical blowing agent and is applied under pressure from a pressurized container to the substrate to be coated.

6. In the process according to claim 5, wherein the foamable mixture applied to the substrate is distributed flatly by one of a blade and a knife to form the layer of varying thickness of one of a regular and an irregular shape and the three-dimensional structure is consequently obtained by foaming, which varies regionally in volume of the structured layer thus formed.

7. In the process according to claim 6, wherein prior to a curing of a first layer of the foamable mixture applied to the substrate for producing a polyurethane foam, a further layer of the foamable mixture is applied and distributed for producing a polyurethane foam.

8. In the process according to claim 7, wherein prior to application of the further layer of the foamable mixture for producing the polyurethane foam, an outer surface of the polyurethane foam layer on which the further layer is to be applied is wetted with water.

9. In the process according to claim 8, wherein with the polyurethane foam layer applied and distributed over the substrate, one of with and without the further layer of the foamable mixture applied to the first layer, after the beginning of foaming and after initiation of crosslinking with formation of a superficial skin, the superficial skin is torn away in places.

10. In the process according to claim 9, wherein the polyurethane foam layer has one of a paint coating and a glaze.

11. In the process according to claim 10, wherein a mechanical treatment of the foamable mixture applied flatly to the substrate is carried out in conjunction with an application of a colorant.

12. In the process according to claim 11, wherein the foamable mixture is low-flammability because of added flame retardants.

13. In the process according to claim 1 wherein the foamable mixture is applied to at least one of external and internal walls of buildings.

14. In the process according to claim 13, wherein the surface of the foamable mixture is wetted with water after structuring of the applied mixture.

15. In the process according to claim 1 wherein the foamable mixture is used in production of paintings and reliefs.

16. In the process according to claim 1, wherein the foamable mixture is used which foams and crosslinks only chemically while utilizing a reaction between isocyanate and water, after flat application to the substrate in the presence of atmospheric moisture.

17. In the process according to claim 16, wherein the surface of the mixture distributed over the substrate is wetted with water in selected regions or overall to promote chemical foaming of the foamable mixture.

18. In the process according to claim 1, wherein the foamable mixture contains a physical blowing agent and is applied under pressure from a pressurized container to the substrate to be coated.

19. In the process according to claim 1, wherein the foamable mixture applied to the substrate is distributed flatly by one of a blade and a knife to form the layer of varying thickness of one of a regular and an irregular shape and the three-dimensional structure is consequently obtained by foaming, which varies regionally in volume of the structured layer thus formed.

20. In the process according to claim 1, wherein prior to a curing of a first layer of the foamable mixture applied to the substrate for producing a polyurethane foam, a further layer of the foamable mixture is applied and distributed for producing a polyurethane foam.

21. In the process according to claim 20, wherein prior to application of the further layer of the foamable mixture for producing the polyurethane foam, an outer surface of the polyurethane foam layer on which the further layer is to be applied is wetted with water.

22. In the process according to claim 1, wherein with the polyurethane foam layer applied and distributed over the substrate, one of with and without a further layer of the foamable mixture applied to the first layer, after the beginning of foaming and after initiation of crosslinking with formation of a superficial skin, the superficial skin is torn away in places.

23. In the process according to claim 1, wherein the polyurethane foam layer has one of a paint coating and a glaze.

24. In the process according to claim 1, wherein a mechanical treatment of the foamable mixture applied flatly to the substrate is carried out in conjunction with an application of a colorant.

25. In the process according to claim 1, wherein the foamable mixture is low-flammability because of added flame retardants.

26. In the process according to claim 1 wherein the polyurethane foam is produced by a physical blowing process with a physical blowing agent in combination with a chemical owing process.

* * * * *